US009420383B1

(12) United States Patent
Lee et al.

(10) Patent No.: US 9,420,383 B1
(45) Date of Patent: Aug. 16, 2016

(54) SMART HEARING AMPLIFIER DEVICE

(71) Applicant: Cheng Uei Precision Industry Co., Ltd., New Taipei (TW)

(72) Inventors: James Lee, New Taipei (TW); Kuo Yang Wu, New Taipei (TW); Sheng Chieh Lo, New Taipei (TW); Wen Bing Hsu, New Taipei (TW); Hsiang Ling Chung, New Taipei (TW); Hsin Chang Chen, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 14/828,638

(22) Filed: Aug. 18, 2015

(30) Foreign Application Priority Data

Apr. 22, 2015 (TW) ..... 104206121 U

(51) Int. Cl.
*H04R 25/00* (2006.01)

(52) U.S. Cl.
CPC ..... *H04R 25/50* (2013.01); *H04R 25/554* (2013.01)

(58) Field of Classification Search
CPC ..... A61B 5/02438; A61B 5/0488; H04M 2250/12; H04R 25/50; H04R 25/505
USPC ..... 381/74, 315, 320; 600/25, 323; 29/595
See application file for complete search history.

(56) References Cited

U.S. PATENT DOCUMENTS

2015/0257662 A1* 9/2015 Lee ..... A61B 5/02427 600/323
2015/0281856 A1* 10/2015 Park ..... H04R 25/505 381/320
2015/0312669 A1* 10/2015 Song ..... A61B 5/02438 381/74
2015/0358720 A1* 12/2015 Campbell ..... H04R 1/1091 381/151

FOREIGN PATENT DOCUMENTS

WO WO2008067122 * 6/2008

* cited by examiner

*Primary Examiner* — Davetta W Goins
*Assistant Examiner* — Phylesha Dabney
(74) *Attorney, Agent, or Firm* — Lin & Associates Intellectual Property, Inc.

(57) ABSTRACT

The smart hearing amplifier device is placed in an ear of a user to receive voices of speakers. The smart hearing amplifier device includes a Bluetooth chipset, a photoplethysmography (PPG) sensor, a gravity-sensor (G sensor) and a microcontroller unit (MCU). The PPG sensor emits lights onto the skin of the ear and captures reflected lights from the skin and then outputs PPG signals. The G sensor senses a triaxial gravitational variation of the user and then outputs sensed signals. The MCU is connected with the PPG sensor, the G sensor and the Bluetooth chipset. The MCU processes PPG signals from the PPG sensor and the sensed signals from the G sensor and eliminates noise signals of the PPG signals and the sensed signals, and then calculates bio-data of the user. The Bluetooth chipset receives the bio-data from the MCU and transmits the bio-data to a smart device.

3 Claims, 6 Drawing Sheets

SMART HEARING AMPLIFIER DEVICE

CROSS-REFERENCE TO RELATED APPLICATION

The present application is based on, and claims priority form, Taiwan Patent Application No. 104206121, filed Apr. 22, 2015, the disclosure of which is hereby incorporated by reference herein in its entirety.

BACKGROUND OF THE INVENTION

1. Field of the Invention

The present invention relates to a hearing amplifier device, and more particularly to a multifunction smart hearing amplifier device.

2. The Related Art

Hearing amplifier device can improve the hearing impairment and the ability of the communication with others. A usual means of a traditional hearing amplifier device is only amplifying the received sound. However, the received sound contains much noise, this will cause the difficulty for listening. By the way, the traditional hearing amplifier device has a defect of single function and can only achieve the communication purpose between the hearing impaired patients and others. Therefore, it is necessary to provide a hearing amplifier device with a variety of functions to meet the needs of consumers.

SUMMARY OF THE INVENTION

Accordingly, an object of the present invention is to provide a smart hearing amplifier device placed in an ear of a user to receive voices of speakers and connected to a smart device. The smart hearing amplifier device includes a source microphone, a Bluetooth chipset, an anti-noise source module, an amplifier, a speaker, a photoplethysmography (PPG) sensor, a gravity-sensor (G sensor) and a microcontroller unit (MCU). The source microphone is used to receive the voices of speakers. The Bluetooth chipset is connected to the source microphone. The Bluetooth chipset converts the voices of the speakers from analog signals to digital signals, and then implements an anti-noise processing to reduce the noise around the source microphone, and further transmits the digital signals which have been reduced the noise to the smart device or the anti-noise source module. The anti-noise source module is connected to the Bluetooth chipset. The anti-noise source module converts the digital signals transmitted by the Bluetooth chipset to analog signals. The amplifier is connected to the anti-noise source module. The amplifier receives and amplifies the analog signals from the anti-noise source module. The speaker is connected to the amplifier. The speaker receives the analog signals amplified by the amplifier and then converts the amplified analog signals to sound signals for the user. The PPG sensor emits lights onto the skin of the ear of the user and captures reflected lights from the skin of the ear and then outputs PPG signals. The G sensor senses a triaxial gravitational variation of the user and then outputs sensed signals. The MCU is connected with the PPG sensor, the G sensor and the Bluetooth chipset. The MCU controls PPG sensor. The MCU processes the PPG signals from the PPG sensor and the sensed signals from G sensor and eliminates noise signals of the PPG signals and the sensed signals, and then calculates bio-data of the user. The bio-data are transmitted to the Bluetooth chipset. The Bluetooth chipset transmits the bio-data to the smart device.

As described above, the anti-noise source module optimizes the digital signals of the voices of the speakers from the Bluetooth chipset, so that the smart hearing amplifier device has a better sound effect. In addition, the MCU processes PPG signals from the PPG sensor and the sensed signals from the G sensor and eliminates noise signals of the PPG signals and the sensed signals, and then calculates bio-data of the user and transmits the bio-data to the Bluetooth chipset. The Bluetooth chipset transmits the bio-data to the smart device for displaying out. Thus the smart hearing amplifier device achieves multifunction to meet the diverse needs of consumers.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
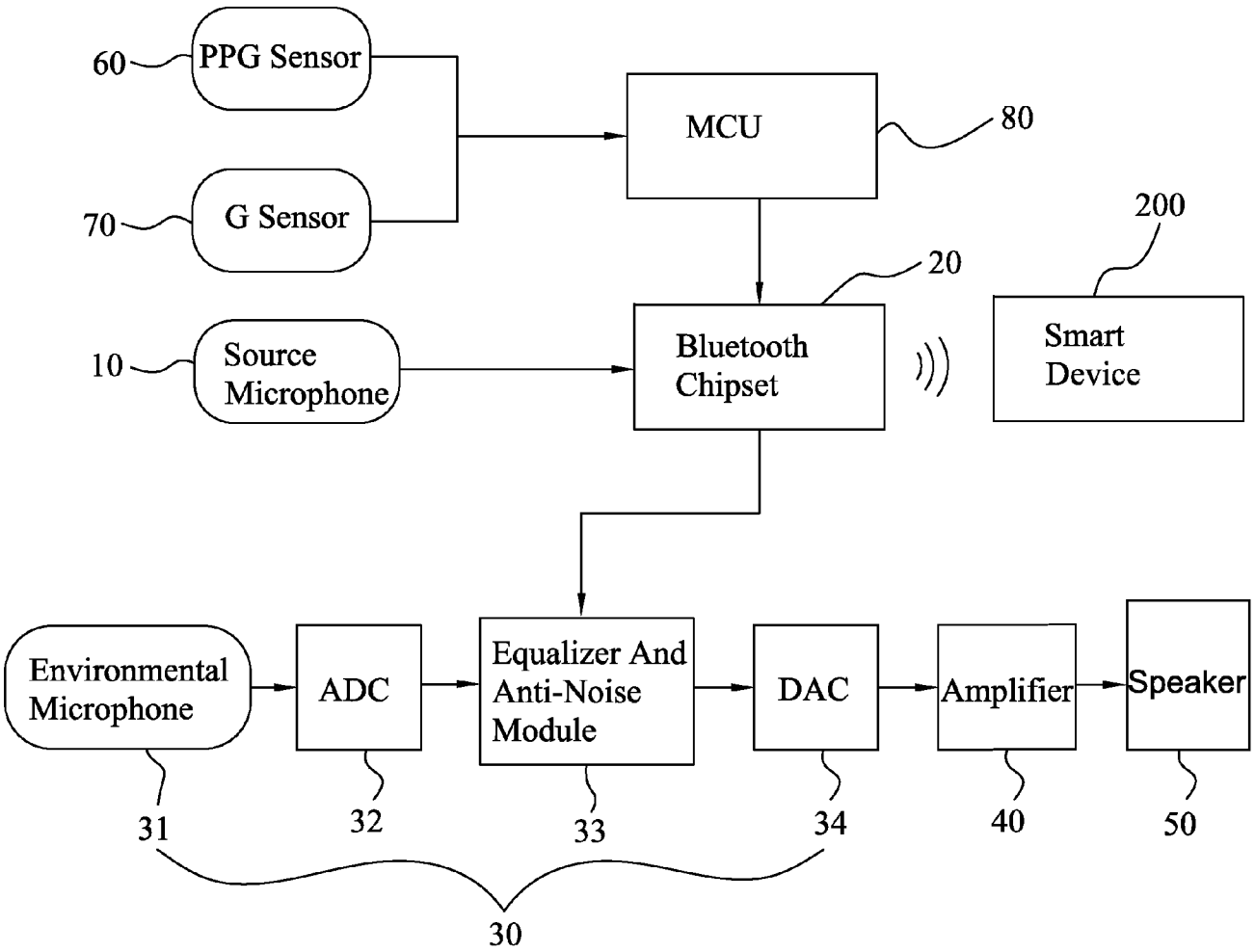
FIG. 1 is a block diagram of a smart hearing amplifier device according to an embodiment of the present invention.

With reference to FIG. 1, an embodiment of the invention is embodied in a smart hearing amplifier device. The smart hearing amplifier device is placed in an ear of a user to receive voices of speakers and connected to a smart device 200 such as cell phones, tablet computers and so on. The smart hearing amplifier device includes a source microphone 10, a Bluetooth chipset 20, an anti-noise source module 30, an amplifier 40, a speaker 50, a photoplethysmography (PPG) sensor 60, a gravity-sensor (G sensor) 70, a microcontroller unit (MCU) 80.

Referring to FIG. 1, the source microphone 10 is used to receive the voices of the speakers and includes two microphones (not shown). The Bluetooth chipset 20 is connected to the source microphone 10. The Bluetooth chipset 20 converts the voices of the speakers from analog signals to digital signals and then implements an anti-noise processing by beamforming to reduce the noise around the source microphone 10, and further transmits the digital signals which have been reduced the noise to the smart device 200 or the anti-noise source module 30.

Referring to FIG. 1, the anti-noise source module 30 is connected to the Bluetooth chipset 20. The anti-noise source module 30 converts the digital signals transmitted by the Bluetooth chipset 20 to analog signals. The anti-noise source module 30 includes an environmental microphone 31, an analog-to-digital converter (ADC) 32, an equalizer and anti-noise module 33 and a digital-to-analog converter (DAC) 34. The environmental microphone 31 receives environmental voices. The ADC 32 is connected to the environmental microphone 31 and converts the environmental voices from analog signals to digital signals. Then the digital signals of the environmental voices are transmitted to the equalizer and anti-noise module 33. The equalizer and anti-noise module 33 optimizes the digital signals of the environmental voices and eliminates external environmental noise. The equalizer and anti-noise module 33 is further connected to the Bluetooth chipset 20 and optimizes the digital signals of the voices of the speakers transmitted from the Bluetooth chipset 20. The digital signals of the environmental voices and the voices of the speakers which have been processed are transmitted to the DAC 34 and converted to analog signals by the DAC 34. The analog signals are transmitted to the amplifier 40.

Referring to FIG. 1, the amplifier 40 is connected to the anti-noise source module 30. The amplifier 40 receives and amplifies the analog signals of the environmental voices and the voices of the speakers from the anti-noise source module 30. The speaker 50 is connected to the amplifier 40 and receives the analog signals amplified by the amplifier 40 and then converts the amplified analog signals to sound signals for the user.

Referring to FIG. 1, the PPG sensor 60 includes a light source module (not shown) and a photo detector (not shown). In this embodiment, the light source module includes three light sources, and the light sources are infrared LEDs. In use, the light source module is controlled by the MCU 80 to emit lights onto the skin of the ear of the user from different directions, the photo detector captures reflected lights from the skin of the ear and outputs PPG signals to the MCU 80. The G sensor 70 senses a triaxial gravitational variation of the user and then outputs sensed signals to the MCU 80.

Figure 2:
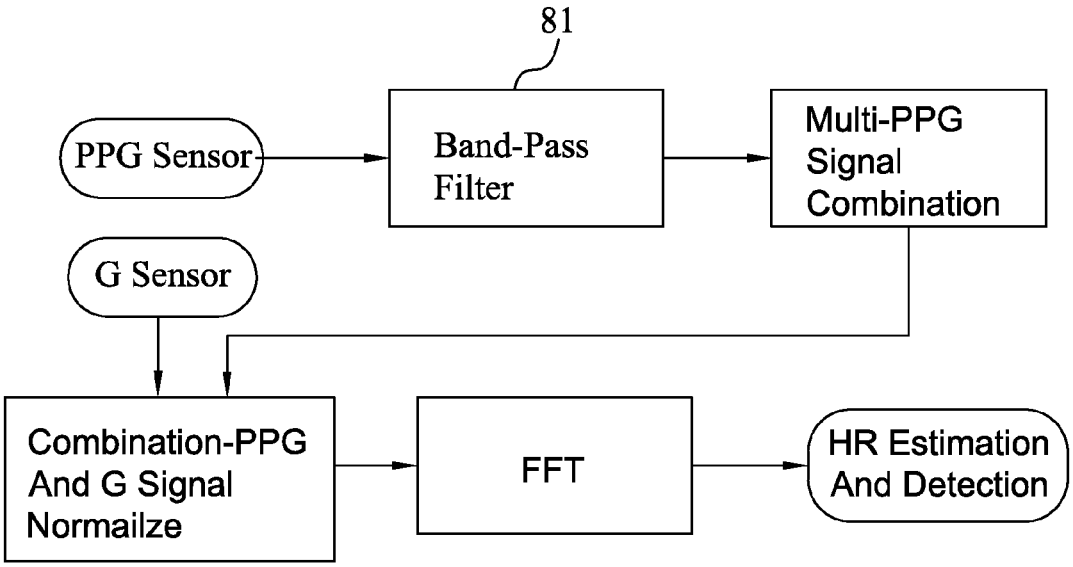
FIG. 2 is a flow chart showing the smart hearing amplifier device calculating data of the HR of the user.
Figure 6:
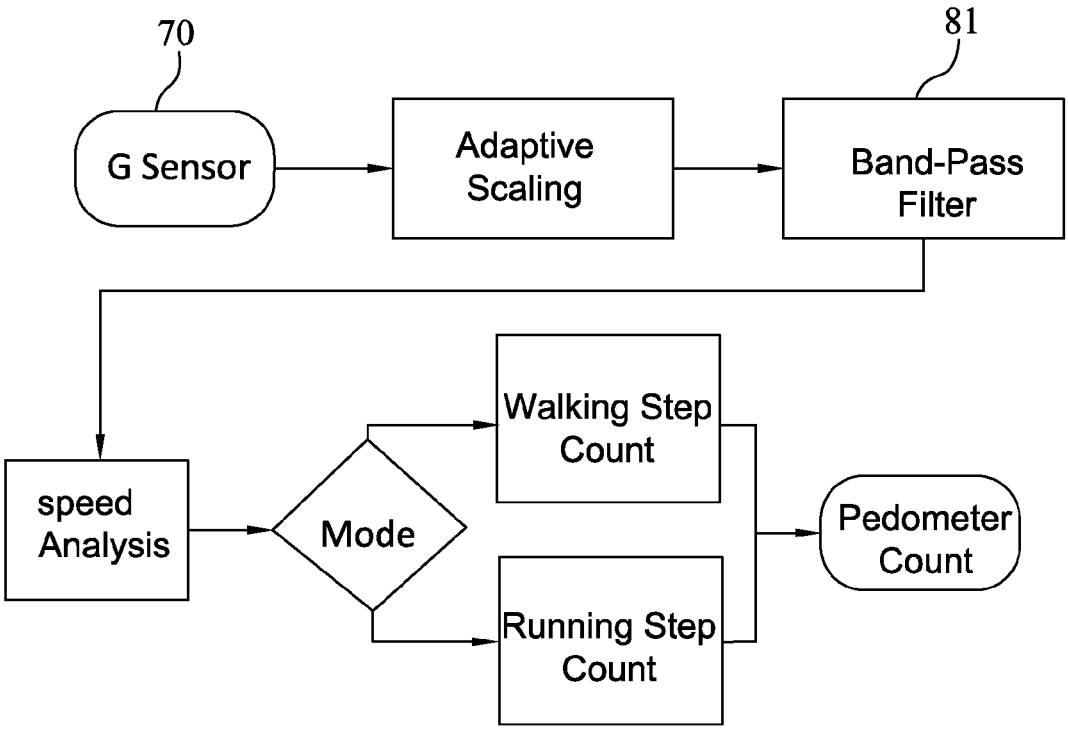
FIG. 6 is a flow chart showing the smart hearing amplifier device calculating data of the step count values.

Referring to FIG. 1, FIG. 2 and FIG. 6, the MCU 80 is connected with the PPG sensor 60, the G sensor 70 and the Bluetooth chipset 20. The MCU 80 controls the light source module and time sequence of the received light source. The MCU 80 processes the PPG signals from the PPG sensor 60 and the sensed signals from G sensor 70 and eliminates noise signals of the PPG signals and the sensed signals. In detail, the MCU 80 includes a band-pass filter 81. The noise signals from the PPG sensor 60 and the G sensor 70 are eliminated by the band-pass filter 81. Then the MCU 80 calculates bio-data of the user's heart rate (HR), heart rate variability (HRV), activity amount, sleep quality, step count values and other related bio-data. And these bio-data are transmitted to the Bluetooth chipset 20. Finally the Bluetooth chipset 20 transmits the bio-data to the smart device 200 for displaying the bio-data for the user.

Referring to FIG. 1 and FIG. 2, the steps and processes of HR calculation are as follows: The MCU 80 sends an instruction to the light source module of the PPG sensor 60. The light source module emits lights onto the skin of the user from different directions. The photo detector of the PPG sensor 60 captures reflected lights from the skin of the user and outputs PPG signals to the MCU 80. The band-pass filter 81 of the MCU 80 eliminates the noise signals transmitted from the PPG sensor 60. Then the MCU 80 calculates multi-PPG signal combination and finds an optimal signal. And then, the G sensor 70 normalizes the optimal signal. Finally, the MCU 80 deduces the heartbeat by fast fourier transformation (FFT).

Figure 3:
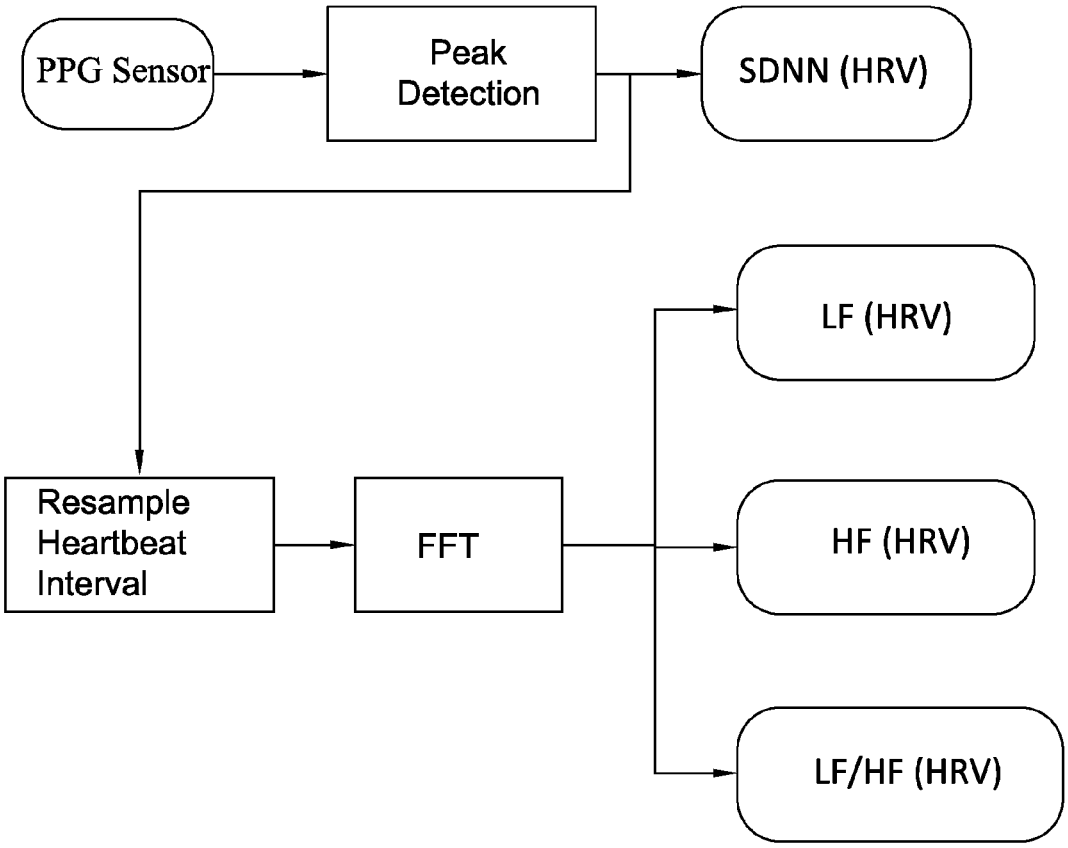
FIG. 3 is a flow chart showing the smart hearing amplifier device calculating data of the HRV of the user.

Referring to FIG. 1 and FIG. 3, the steps and processes of HRV calculation are as follows: The MCU 80 sends an instruction to the light source module of the PPG sensor 60. The light source module emits lights onto the skin of the user from different directions. The photo detector of the PPG sensor 60 captures reflected lights from the skin of the user and outputs PPG signals to the MCU 80. The MCU 80 detects a heartbeat peak and calculates standard deviation of the NN intervals (SDNN). At the same time, the MCU 80 resample heartbeat interval and then deduces the low-frequency (LF), the high-frequency (HF) and the ratio of low-frequency and high-frequency (LF/HF) by FFT to measure sympathetic activity, parasympathetic activity and autonomic nervous system activity.

Figure 4:
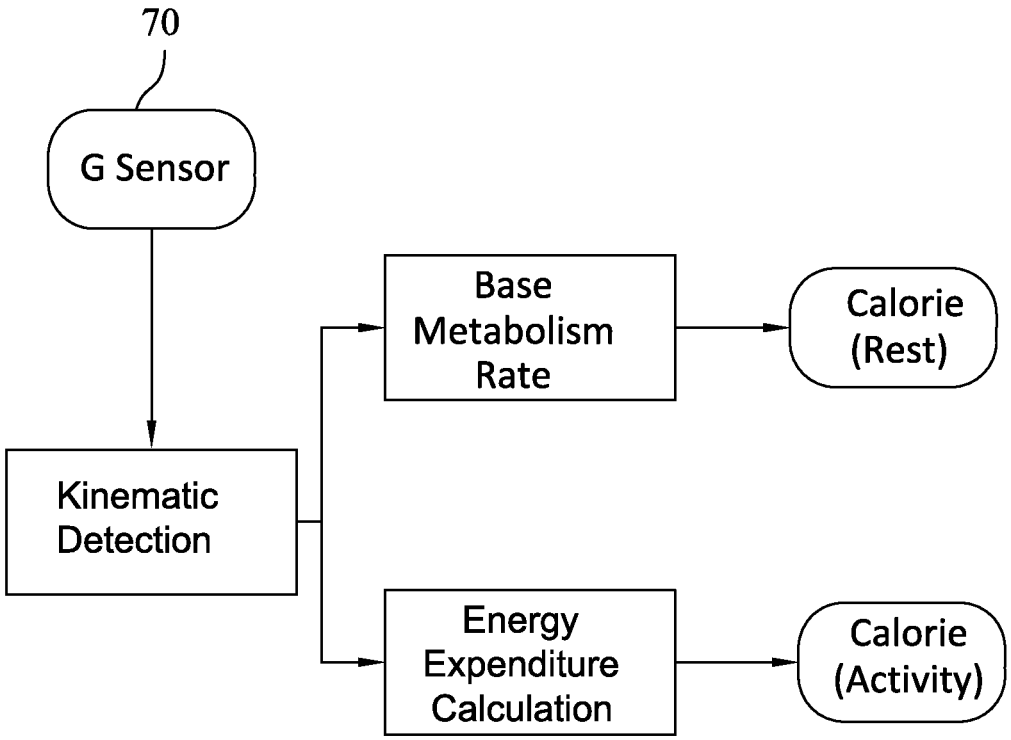
FIG. 4 is a flow chart showing the smart hearing amplifier device calculating data of the activity of the user.

Referring to FIG. 1 and FIG. 4, the steps and processes of activity calculation are as follows: The G sensor 70 senses a triaxial gravitational variation of the user and outputs sensed signals to the MCU 80. The MCU 80 detects kinetic energy according to the sensed signals. At rest, the MCU 80 calculates calorie consumption according to the user's base metabolism rate. In activity, the MCU 80 calculates calorie consumption according to energy expenditure calculation.

Figure 5:
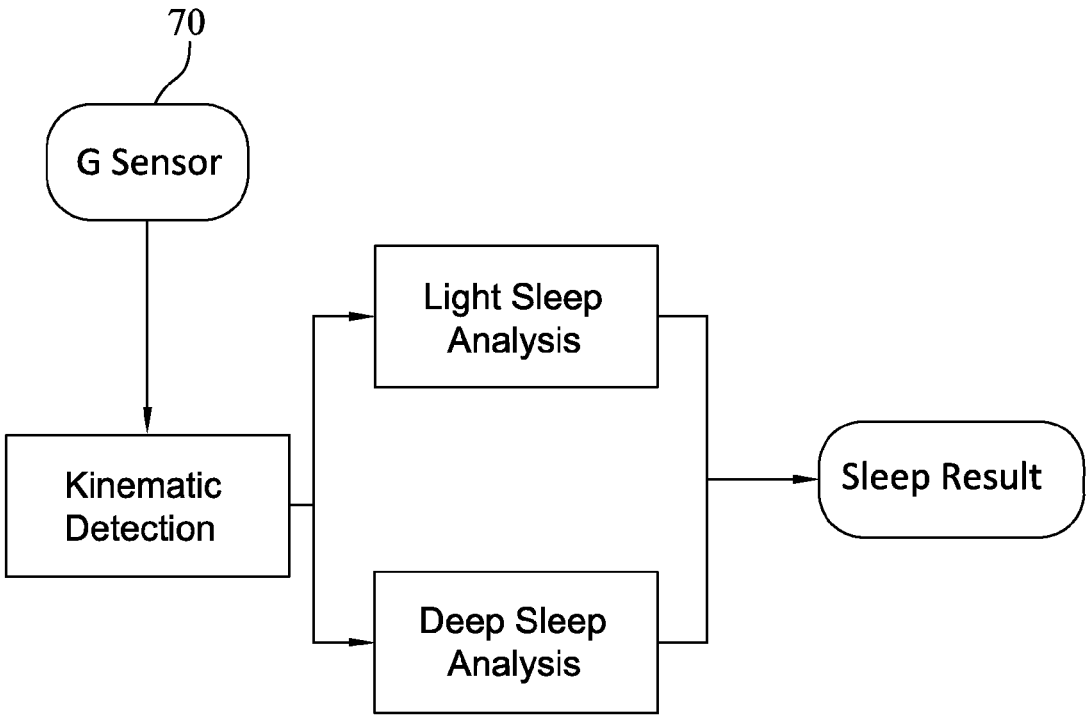
FIG. 5 is a flow chart showing the smart hearing amplifier device calculating data of the sleep quality of the user.

Referring to FIG. 1 and FIG. 5, the steps and processes of sleep quality calculation are as follows: The G sensor 70 senses a triaxial gravitational variation of the user and outputs sensed signals to the MCU 80. The MCU 80 detects kinetic energy according to the sensed signals to determine the user's duration of light sleep and deep sleep, then analyzes the quality of the sleep or sleep results.

Referring to FIG. 1 and FIG. 6, the steps and processes of step count values calculation are as follows: The G sensor 70 senses a triaxial gravitational variation of the user coordinating with adaptive scaling and outputs sensed signals to the MCU 80. The band-pass filter 81 of the MCU 80 eliminates the noise signals transmitted from the G sensor 70. The MCU 80 detects kinetic energy according to the sensed signals and analyzes the user's speed to determine that the mobile mode is walking step count or running step count. The MCU 80 calculates the step count values in walking and running modes and adds the step count values together to calculate the final pedometer result.

As described above, the environmental microphone 31 receives the environmental voices and transmits the environmental voices to the equalizer and anti-noise module 33 to optimize the digital signals of the environmental voices and eliminate external environmental noises. The equalizer and anti-noise module 33 also optimizes the digital signals of the voices of the speakers from the Bluetooth chipset 20. Therefore, the smart hearing amplifier device has a better sound effect. In addition, the MCU 80 processes PPG signals from the PPG sensor 60 and the sensed signals from the G sensor 70 and eliminates noise signals of the PPG signals and the sensed signals, and then calculates bio-data of HR, HRV, activity amount, sleep quality, step count values and other related bio-data and transmits the bio-data to the smart device 200 for displaying out. Thus the smart hearing amplifier device achieves multifunction to meet the diverse needs of consumers.

What is claimed is:

1. A smart hearing amplifier device placed in an ear of a user to receive voices of speakers and connected to a smart device, comprising:

a source microphone for receiving the voices of the speakers;

a Bluetooth chipset connected to the source microphone, the Bluetooth chipset converting the voices of the speakers from analog signals to digital signals, and then implementing an anti-noise processing to reduce the noise around the source microphone, and further transmitting the digital signals which have been reduced the noise to the smart device or the anti-noise source module;

an anti-noise source module connected to the Bluetooth chipset, the anti-noise source module converting the digital signals transmitted by the Bluetooth chipset to analog signals;

an amplifier connected to the anti-noise source module, the amplifier receiving and amplifying the analog signals from the anti-noise source module;

a speaker connected to the amplifier, the speaker receiving the analog signals amplified by the amplifier and then converting the amplified analog signals to sound signals for the user;

a photoplethysmography (PPG) sensor for emitting lights onto the skin of the ear of the user and capturing reflected lights from the skin of the ear and then outputting PPG signals;

a gravity-sensor (G sensor) sensing a triaxial gravitational variation of the user and then outputting sensed signals; and a microcontroller unit (MCU) connected with the PPG sensor, the G sensor and the Bluetooth chipset, the MCU controlling the PPG sensor, the MCU processing the PPG signals from the PPG sensor and the sensed signals from G sensor and eliminating noise signals of the PPG signals and the sensed signals, and then calculating bio-data of the user, the bio-data being transmitted to the Bluetooth chipset, the Bluetooth chipset transmitting the bio-data to the smart device.

2. The smart hearing amplifier device as claimed in claim 1, wherein the MCU includes a band-pass filter, the noise signals from the PPG sensor and the G sensor are eliminated by the band-pass filter.

3. The smart hearing amplifier device as claimed in claim 1, wherein the anti-noise source module includes an environmental microphone, an analog-to-digital converter (ADC), an equalizer and anti-noise module and a digital-to-analog converter (DAC), the environmental microphone receives environmental voices, the ADC is connected to the environmental microphone and converts the environmental voices from analog signals to digital signals, the digital signals of the environmental voices are transmitted to the equalizer and anti-noise module, the equalizer and anti-noise module optimizes the digital signals of the environmental voices and eliminates external environmental noise, the equalizer and anti-noise module is further connected to the Bluetooth chipset and optimizes the digital signals of the voices of the speakers transmitted from the Bluetooth chipset, the digital signals of the environmental voices and the voices of the speakers which have been processed are transmitted to the DAC and converted to analog signals by the DAC, the analog signals are transmitted to the amplifier.

* * * * *